US005897286A

United States Patent [19]

Whittaker

[11] Patent Number: 5,897,286

[45] Date of Patent: Apr. 27, 1999

[54] FORKLIFT PALLET STOP

[76] Inventor: Howard E Whittaker, 8422 Standustrial Ave., Stanton, Calif. 90680

[21] Appl. No.: 08/975,740

[22] Filed: Nov. 21, 1997

[51] Int. Cl.[6] ..... B66F 19/00

[52] U.S. Cl. ..... 414/607; 414/608; 414/785; 187/237

[58] Field of Search ..... 414/607, 608, 414/785; 182/237, 222; 294/931; 254/DIG. 4

[56] References Cited

U.S. PATENT DOCUMENTS

| | | | |
|---|---|---|---|
| 3,310,189 | 3/1967 | Vander Wal | 414/607 |
| 4,102,466 | 7/1978 | Schuster . | |
| 4,113,110 | 9/1978 | Mittag . | |
| 4,239,446 | 12/1980 | Vucinic . | |
| 4,292,899 | 10/1981 | Steffen . | |
| 4,395,190 | 7/1983 | Barchard . | |
| 4,669,949 | 6/1987 | Sutton . | |
| 4,735,153 | 4/1988 | Wong | 414/608 X |
| 4,747,610 | 5/1988 | Yingling et al. . | |
| 4,802,813 | 2/1989 | Perry . | |
| 4,919,465 | 4/1990 | Gembarosky et al. . | |
| 5,076,175 | 12/1991 | Whatley, II . | |
| 5,174,710 | 12/1992 | Dragos | 414/607 |
| 5,208,753 | 5/1993 | Acuff . | |
| 5,221,176 | 6/1993 | Allen et al. | 414/607 X |
| 5,456,565 | 10/1995 | Pigott et al. | 414/607 |
| 5,575,608 | 11/1996 | Yau et al. | 414/607 |

*Primary Examiner*—Frank E. Werner
*Attorney, Agent, or Firm*—James G. O'Neill

[57] ABSTRACT

Pallet stops are provided for blades of a forklift truck. The pallet stops have elongated bodies of a predetermined length, and are easily placed on or removed from forklift blades in predetermined locations. For retrofitting existing forklift blades, the elongated bodies include magnets for removably securing the pallet stops to the blades, while for new forklift blades, the blades may have threaded openings formed in predetermined locations, and elongated pins may be selectively inserted into one of the threaded openings on each blade.

10 Claims, 2 Drawing Sheets

FORKLIFT PALLET STOP

BACKGROUND OF THE INVENTION

1. Field of the Invention

This invention relates generally to forklift trucks, and more particularly, to a forklift pallet stop for use on a forklift blade to aid in accurately aligning a load, and to prevent damage to adjacent pallets and materials by forklift blades.

2. Description of Related Art

Forklift trucks for moving pallets and goods thereon are widely used. Because of the different materials and pallets which may be moved by known forklifts, adapters, alignment devices, covers, protectors, and other means have been developed therefor. Examples of such known means for forklifts are shown by U.S. Pat. Nos. 4,102,464, 4,239,446, 4,395,190, 4,669,949, 4,747,610, 4,802,813 4,919,465, 5,174,710, 5,208,753 and 5,221,176. However, these known devices and means do not provide for the exact positioning of the blades of a forklift, under a pallet, to prevent damage to adjacent pallets when a series of pallets is to be moved from or lowered into position.

Furthermore, it is known to provide elements or plates for posts and/or pallets to protect such pallets when used with forklifts. Examples of pallet protectors are shown in U.S. Pat. Nos. 4,113,110, 4,292,899 and 5,076,175.

After numerous attempts to solve the problems which occur because of the length of forklift blades extending from under a pallet, and the damage caused thereby, the need for a simple, low-cost, easy-to-manufacture pallet stop which may be mounted on either or both of the blades of a forklift vehicle, to aid in accurately aligning a load, and to prevent damage by the blades, and which pallet stop has a long life, is simple and comparatively low in cost to manufacture, and is not easily lost or detached from the forklift or blade on which it is used, still exists.

SUMMARY OF THE INVENTION

Accordingly, it is a general object of the present invention to provide a pallet stop for a forklift blade. It is a particular object of the present invention to provide a pair of stops for the blades of a forklift. It is a still more particular object of the present invention to provide pallet stops for forklift blades to be used with metal pallets. It is a further particular object of the present invention to provide forklift blade pallet stops having magnetic holding means secured therein. And, it is yet a more particular object of the present invention to provide pallet stops for easy insertion into and removal from openings formed in modified forklift blades.

In accordance with one aspect of the present invention, there is provided a pallet stop having an elongated body for support on a forklift blade, so as to aid in aligning the load and preventing the ends of the blades from extending outwardly, past the pallet. The pallet stops are usually used in pairs, for accurately controlling the distance a pair of forklift blades are inserted under a pallet, when moving the pallet, and may take the form of elongated, rectangular elements with magnetic holders, or elements inserted and held in openings formed in the forklift blades.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENTS

The following description is provided to enable any person skilled in the art to make and use the invention, and sets forth the best modes contemplated by the inventor of carrying out his invention. Various modifications, however, will remain readily apparent to those skilled in the art, since the generic principles of the present invention have been defined herein specifically to describe a pallet stop for use on a forklift blade.

Figure 1:
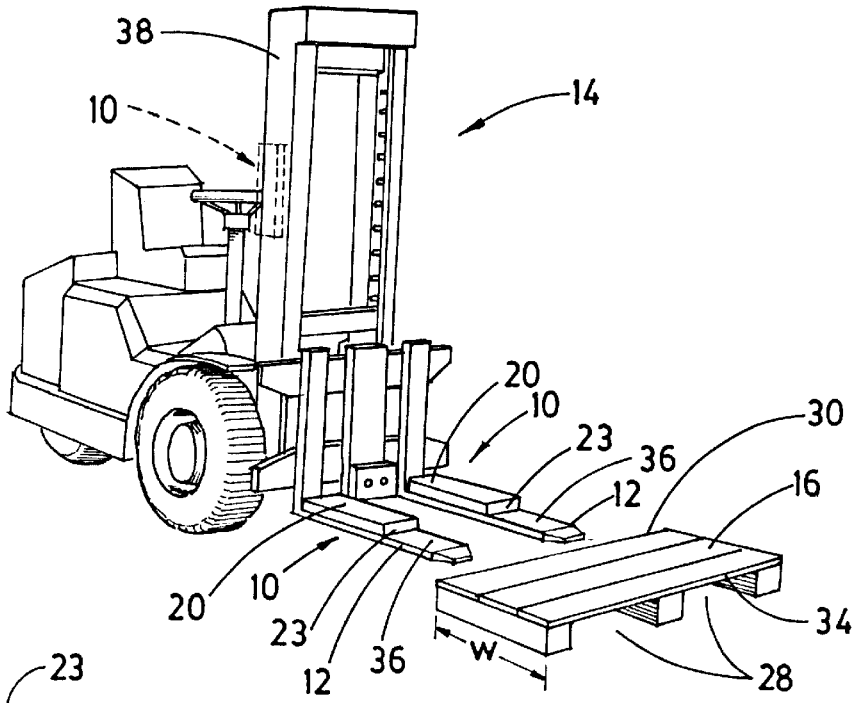
FIG. 1 is a perspective view of a forklift, having a pair of pallet stops of a first embodiment of the present invention mounted on the blades of the forklift, prior to the insertion of the blades under a pallet.
Figure 2:
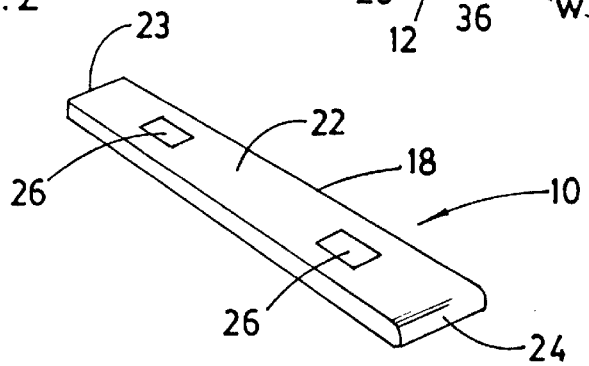
FIG. 2 is a perspective view of the bottom surface of the first embodiment of the pallet stop of the present invention, showing a pair of magnetic holders secured therein.
Figure 3:
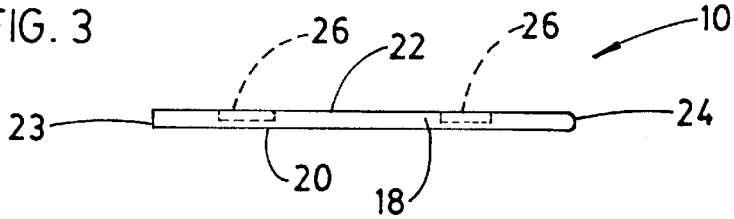
FIG. 3 is a side elevational view of FIG. 2.
Figure 4:
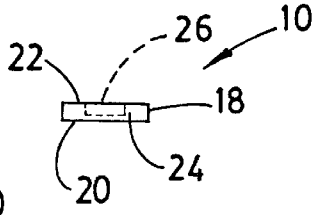
FIG. 4 is an end view of FIG. 2.
Figure 5:
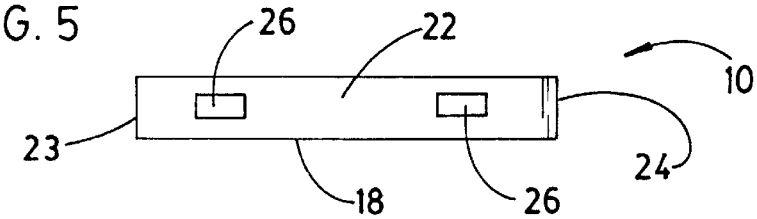
FIG. 5 is a bottom plan view of FIG. 2.

A first embodiment of a pallet stop is shown at 10, and is generally used in pairs, for mounting or securing on a pair of blades 12 of a standard forklift 14, such as shown in FIG. 1. Although pallet stops 10 may generally be mounted and held on any metallic forklift blade for use with any pallet, the stop 10 of the present invention are preferably used when moving metal pallets 16, having a predetermined width.

The first embodiment of the pallet stop 10 is illustrated in FIGS. 1 through 5 of the drawings. Pallet stop 10 comprises an elongated body 18, preferably made from plastic or wood, such as an impact-resistant plastic, in any known or desired manner. The elongated body 18 is preferably rectangular and includes a top surface 20, a bottom surface 22, two ends 23, 24 and a pair of holders 26. The holders 26 may take any desired form, but are preferably one or more magnets, or the like, held in one or more openings formed in bottom surface 22.

FIGS. 2 through 5 most clearly show the elongated, rectangular body 18, while FIG. 1 most clearly shows how a pair of the pallet stops 10 are removably mounted on the forklift blades 12, with their bottom surfaces 22 secured thereto by the holders 26. In addition, each of the pallet stops 10 is shown as being formed with one substantially flat end 23, and a curved end 24, which curved end 24, mates with the attached end of the forklift blade 12, when mounted thereon.

The embodiment of the invention shown in FIGS. 1 through 5 is preferably for use with existing forklift blades as they come from the manufacturers. The pallet stops 10 are formed in a known manner, and are mounted so as to extend along the blades 12, with the rounded ends 24 pressed against the interior or attached ends of the blades 12, and the flat ends 23 pointing towards free ends 32 and extending perpendicularly to each blade. In this position, when the free ends 32 of the blades 12 of the forklift are inserted into openings 28, formed under the pallet 16, the free ends 32 of the blades will be limited or stopped in their forward progress when the flat ends 23 reach or abut against a first side edge 30 of pallet 16. In the fully inserted position, the free ends 32 of the blades will be aligned with or behind a second side edge 34 of pallet 16, and both flat ends 23 will abut against first side edge 30. The pallet stops 10 are preferably sized and dimensioned so that they are the same width as the blades 12, with their lengths less than the blades, so that when the stops are mounted on the blades, a space 36 is formed on each blade, between flat ends 23 of the stops 10 and the free ends 32 of the blades. This space 36 is selected so as to be equal to the width "w" of pallet 16.

For example, the pallet stop 10 may be made from plastic or wood, for use with 22 inch wide steel pallets. Each of the stops 10 would be approximately 2 inches thick by 6 inches wide by 26 inches long, for use on steel forklift blades that are about 4 feet long. A pair of holes or openings are milled or formed in the bottom surface 22 of each pallet stop 10, and a pair of magnets 26, approximately 2 inches wide by 3 inches long and 1 inch thick, are inserted and held therein, as by the use of an epoxy. The magnets are sufficiently strong to securely hold the stops on the forklift blades, as shown in solid line in FIG. 1, or to store the stops on side rails 38 of the forklift mast, as shown in broken line in FIG. 1, to prevent loss or misplacement thereof.

Figure 6:
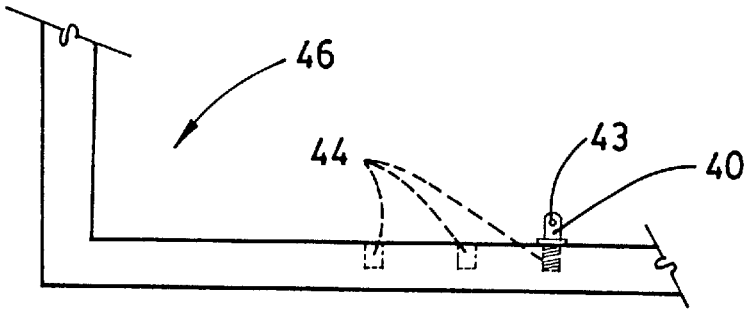
FIG. 6 is a partial side elevational view of a modified forklift blade having a second embodiment of a pallet stop, comprising an elongated pin, secured in a threaded opening thereon.
Figure 7:
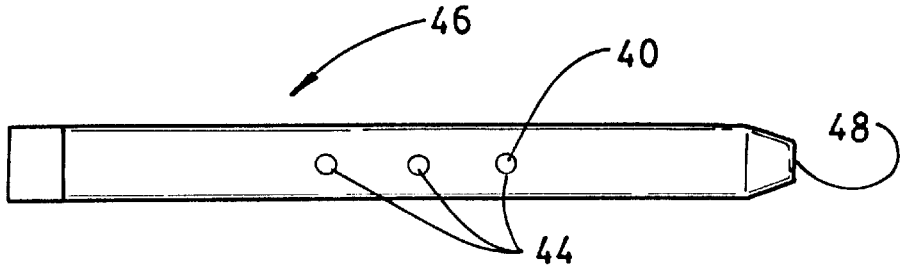
FIG. 7 is a top plan view of FIG. 6.
Figure 8:
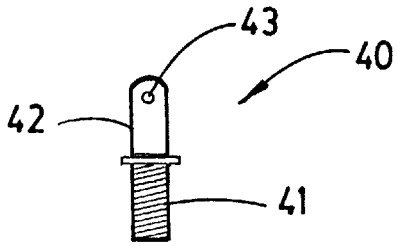
FIG. 8 is a front elevational view of the elongated pin pallet stop.

A second embodiment of the invention is shown in FIGS. 6 through 8 of the drawings. This second embodiment is for use with new forklift blades, which have been produced by, or with the authorization of the forklift manufacturer, and which conform with all safety, security and strength standards. The second embodiment comprises a pallet stop 40, having an elongated body of any desired shape, but which is preferably cylindrical, with a threaded, lower or holding portion 41, and a stop element or upper portion 42, with an opening 43, to aid in turning the pallet stop in a threaded opening. The threaded, lower holding portion 41 may be selectively screwed into a plurality of threaded openings 44, formed in predetermined locations along a centerline of a forklift blade 46. The forklift blade 46 should preferably be engineered by the manufacturer, so as to meet all safety, security and strength requirements. The threaded openings 44, preferably three in number, should not extend entirely through the thickness of the blade, but be bottomed-out therein, as shown in FIG. 6. The threaded openings are spaced apart predetermined distances from each other and from an outer end 48 of the blade 46. For example, the first or outer threaded opening 44 could be spaced approximately 20 to 22 inches from the end 48 of the blade 46, while the other two openings would be spaced about 3 inches or so from the first threaded opening and each other.

It, therefore, can be seen that the pallet stops 10, 40 of the present invention include integral holding and stop portions. The holding portions are selectively securely fixed to forklift blades. Furthermore, the pallet stops are made from material which provides sufficient strength and are ideally sized to aid in aligning a pallet on the forklift blades, and to prevent the outer ends 32, 48 of the forklift blades from extending outwardly from a pallet held on the blades. That is, when a pallet slides on the blades, it will stop when it contacts the pallet stops, thus preventing the forklift blades from extending outwardly from the pallet to thereby avoid damaging adjacent pallets or materials. Furthermore, with the stops on blades 12, 48, pallets 16 may be quickly and easily loaded and aligned on the blades 12, 48, and then moved by the forklift.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What I claim is:

1. In a forklift vehicle having a first metallic forklift blade and a second metallic forklift blade, the improvement comprising:

a first pallet stop removably mounted on a top surface of the first metallic forklift blade;

a second pallet stop removably mounted on a top surface of the second metallic forklift blade;

a pallet having a predetermined width, a first side edge, a second side edge, a top surface, a bottom surface and a plurality of supports secured to the bottom surface for supporting the pallet on a flat surface;

the first pallet stop and the second pallet stop each having an elongated body comprised of a stop portion and a holding portion; each elongated body having a top surface, a bottom surface, two sides, a first straight end and a second rounded end; a pair of openings formed in each bottom surface; magnetic holding means secured in the pair of openings formed in each bottom surface; and the bottom surface of the first pallet stop being placed on the top surface of the first metallic forklift blade, and the bottom surface of the second pallet stop being placed on the top surface of the second metallic forklift blade to removably hold each pallet stop in position thereon with the rounded end of each elongated body pressed against an inner closed end of each forklift blade, and the first straight end of each elongated body forming the stop portion; whereby open spaces are formed on the top surface of the first metallic forklift blade and the top surface of the second metallic forklift blade between the first straight end of each pallet stop and an open outer end of each forklift blade; and the open spaces on the top surface of the first metallic forklift blade and the top surface of the second metallic forklift blade are equal to the width of the pallet, whereby when the first metallic forklift blade and the second metallic forklift blade are inserted under the bottom surface of the pallet and the first straight end of each elongated body contacts the first side edge, the pallet will just fit, to thereby prevent the open outer end of each forklift blade from extending beyond the second side edge.

2. A pair of pallet stops for removably mounting on forklift blades of a forklift vehicle, comprising:

each of the pair of pallet stops having a rectangular elongated body with two sides, a front end forming a stop portion, a rear end and a holding portion comprised of at least one magnet held in a bottom surface;

a pallet having a first side edge, a second side edge, a top surface, a bottom surface and a plurality of supports secured to the bottom surface for supporting the pallet on a flat surface;

the holding portion of each of the pair of pallet stops being sized and dimensioned to be removably secured to a top portion of one of the forklift blades whereby the front end forming a stop portion of each of the pair of pallet stops is in a predetermined position on one of the forklift blades so as to cooperate with the first side edge of the pallet when the forklift blades are under the bottom surface of the pallet between the plurality of supports, so that outer ends of each of the pair of forklift blades will not extend beyond the second side edge of the pallet.

3. The pair of pallet stops of claim 2 wherein each rear end is rounded, and each front end is squared, and the pallet is made from metal.

4. The pair of pallet stops of claim 3 wherein each elongated body is made from wood.

5. The pair of pallet stops of claim 3 wherein each elongated body is made from plastic.

6. The combination of forklift blades and pallet stops on a forklift vehicle, comprising:

a pallet having a top surface, a bottom surface, a pair of side edges and a plurality of supporting elements secured to the bottom surface for supporting the pallet on a flat surface;

each of the forklift blades having an elongated metallic body with a top surface;

each of the pallet stops having an elongated body having a bottom surface, two sides, a first straight end forming a stop portion and a second rounded end; at least one opening formed in the bottom surface; and at least one magnet secured in the at least one opening for releasably securing each of the pallet stops to the top surface of a selected one of the forklift blades; and with a bottom surface of each of the pallet stops releasably secured to the top surface of the selected one of the forklift blades, a space is formed between the stop portion and an open outer end of each of the forklift blades so that when the forklift blades are inserted under the bottom surface of the pallet, between the plurality of supporting elements, the stop portion of each of the pallet stops will contact a first of the pair of side edges to prevent the open outer end of each of the forklift blades from extending beyond a second of the pair of side edges.

7. The combination forklift blades and pallet stops of claim 6 wherein the elongated body of each of the pallet stops is of a predetermined length, which length is less than the length of each of the forklift blades to which it is attached.

8. The combination forklift blades and pallet stops of claim 7 wherein there are two openings formed in the bottom surface of each of the pallet stops, and there are separate magnets held in the two openings of each of the pallet stops.

9. The combination forklift blade and pallet stops of claim 8 wherein the elongated body of each of the pallet stops is made from wood.

10. The combination forklift blades and pallet stops of claim 8 wherein the elongated body of each of the pallet stops is made from plastic.

* * * * *